United States Patent [19]

Lehman et al.

[11] Patent Number: 4,600,427

[45] Date of Patent: Jul. 15, 1986

[54] METHOD OF LADLE STEELMAKING AND PRODUCT PRODUCED THEREBY

[75] Inventors: Albert L. Lehman, Glenview; Charles W. Finkl, Evanston, both of Ill.

[73] Assignee: A. Finkl & Sons Co., Chicago, Ill.

[21] Appl. No.: 663,808

[22] Filed: Oct. 22, 1984

[51] Int. Cl.[4] ..... C21C 7/10

[52] U.S. Cl. ..... 75/49

[58] Field of Search ..... 75/49

[56] References Cited

U.S. PATENT DOCUMENTS 3,547,622 12/1970 Hutchinson ..... 75/49

3,574,596 4/1971 Lohman ..... 75/49

3,980,469 9/1976 Forster ..... 75/49

*Primary Examiner*—Peter D. Rosenberg

*Attorney, Agent, or Firm*—James G. Staples

[57] ABSTRACT

A method of refining steel in the ladle using a low melting point slag is disclosed. Both ELS and resulfurized steels are subjected to the simultaneous effect of a vacuum and a purging agent, preferably an inert gas, to lower the $H_2$ content into the flake-free range irrespective of the chemistry of the steel, and heat is added via AC arcs from non-consumable electrodes at a temperature only slightly higher than the solidication temperature of the steel, preferably about 2840° F. Steel produced thereby is also disclosed.

13 Claims, 3 Drawing Figures

METHOD OF LADLE STEELMAKING AND PRODUCT PRODUCED THEREBY

This invention relates generally to the art of ladle refining of steel and more specifically to a method of such refining using a low melting point slag which is applicable to a wide range of alloy steels. Said invention is further adapted to produce flake free, extra low sulphur (hereafter ELS) steel using conventional low cost slag constituents in an economical and efficient manner.

There has been a trend in recent years to transfer refining from the electric furnace to the ladle. This trend has come about with the increasing pressure on steel makers to produce quality steel at the lowest possible cost. This stems, in large measure, from the fact that the electric furnace is a very efficient melting tool, but a relatively inefficient refiner. By contrast, newly developed ladle refining equipment, though incapable of, or unsuitable for, melting, are efficient refining tools. Such factors as the increased temperatures usually associated with electric furnace refining, as contrasted to melting, with a consequent high rate of wear of furnace refractories, and the tieup of the large capital investment represented by the electric furnace to perform an inefficient operation are merely two reasons, among many, for the trend toward ladle refining.

One of the most efficient and versatile ladle refining systems in world-wide use today is the vacuum arc heating system, sometimes referred to as the vacuum arc degassing, or VAD, system. Such a system, of which over 20 are in current operation and many more planned or under construction, is described in U.S. Pat. Nos. 3,501,289 and 3,635,696, and the following exemplary description will assume an understanding of these patents and the VAD system as it has been described in the literature, as well as the basic vacuum degassing process described in U.S. Pat. No. 3,236,635.

Figure 1A:
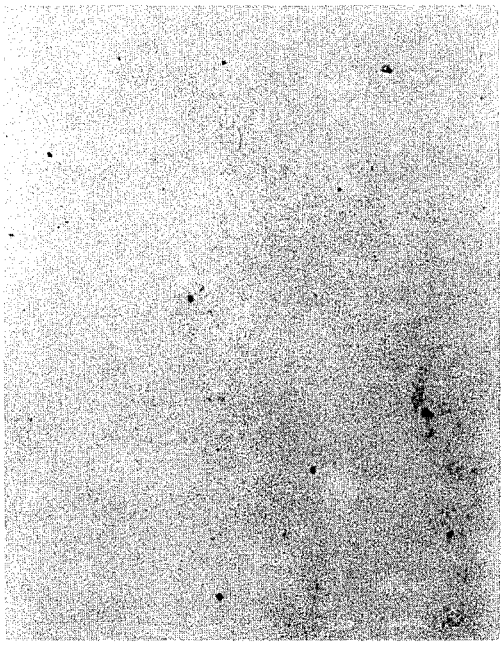
Figure 1B:
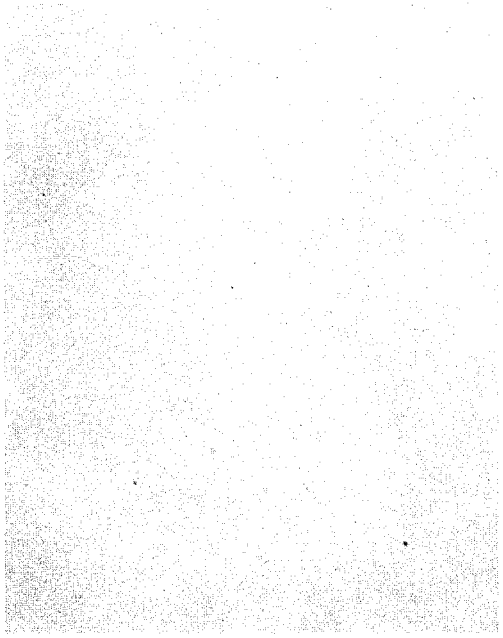
Figure 2:
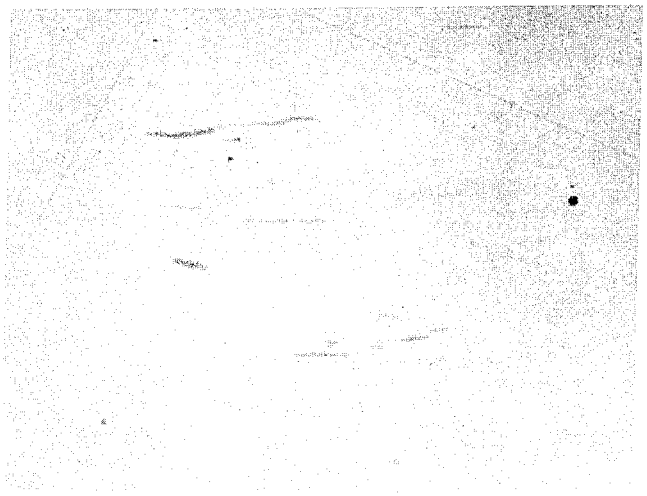

An understanding of the following exemplary description of the invention will be facilitated by reference to the Figures which form a part of this specification and in which:

FIG. 1A and 1B are photographs of a longitudinal micro sample, to a magnification of 100, of a slice through a 0.031 resulfurized steel and another slice through a 0.001 S steel which has been processed in accordance with this invention; and FIG. 2 is a photograph of a macro sample, to a magnification of 100, of a slice through a comparable steel having a sulfur content of 0.032.

The basic VAD ladle refining concept as utilized in this invention is extremely simple and includes the following operations which are described as they have been carried out in a practical application of the invention.

Firstly the bulk of the furnace slag is removed from the melt, and the melt tapped into a ladle. Thereafter the true heat weight is determined, usually with a crane scale. Alloys are added to the ladle. Thereafter the heat is vacuum degassed by simultaneous (a) subjection to a vacuum, which may be as low as one millimeter Hg absolute or even less for a portion of the vacuum treatment time, and (b) the upward passage of a purging agent, preferably an inert gas such as argon or helium, though even dry air may be used. During this phase temperature and chemical homogeniety is achieved, the hydrogen content of the steel is lowered, and the process proceeds under a white disintegrating slag which soon reaches 0.5% FeO or less. Preferably, the FeO content of the slag at the commencement of the cycle is no more than about 8%. Desulfurization under a lime-silica or lime-alumina slag proceeds during the vacuum degassing step and subsequently. The lime-silica or lime-alumina ratio should be between 2:1 and $2\frac{1}{2}$/2:1; experience has shown that a lime-silica ratio of $2\frac{1}{4}$/4:1 will yield excellent results. Following the period during which the melt is subjected to the simultaneous action of a vacuum and a purging agent, but no external heat, the temperature of the heat is adjusted by simultaneous subjection of the heat to (a) a vacuum, (b) a purging agent and (c) a multi-phase AC electric heating arc which is struck directly between non-consummable electrodes and the steel melt. After vacuum treatment, Al, Ti, Cb, B, and Ca alloys may be added as required. For a 60 metric ton heat of medium carbon steel which is treated in a 7.0 MVA VAD refiner, a temperature drop of 30° C. for every 1% gross alloy weight addition is quite accurate, as is a 20° C., drop for every 1% slag mix addition.

These relationships may vary slightly with the size of the heat of course. Knowing such relationsips and the final teem temperature desired and the rate at which heat is added to the melt by the arcs (which is a function of the specific equipment), it is a simple matter to operate the arcs an appropriate period of time to yield a final teem temperature of ±10° C. of the aim teem temperature. The final silicon addition may be added after vacuum treatment, preferably with Ca alloy addition when the specification calls for Ca.

There should be approximately one meter of freeboard in the ladle, or its equivalent such as a removable ring placed on top of the ladle, to confine the wild boil which takes place during the vacuum purging treatment. One-half meter of freeboard can be tolerated if decremental degassing is employed.

A purging system similar to that disclosed in U.S. Pat. No. 3,236,635 can be employed. One purging cone for every 50 short tons of metal has been found to yield ideal agitation. Cycle time can be shortened and reliability improved by using multi-purging cones, depending, of course, on heat size.

Hydrogen removal occurs automatically as the heat is processed in the VAD ladle refiner. It is important to keep slag basicity under control (approximately $2\frac{1}{4}$ to 1 lime-silica ratio) since a low melting point fluid slag is most advantageous.

Sulfur control and sulfide shape control can be accurately achieved by the process. The addition of Ca alloy and Al after the $O_2$ is at its lowest level permits Ca recoveries of 20% and Al recoveries of 90%.

S contents of /0.004 can consistently be produced, many heats being 0.001 S. Sulfide shape control is very easy at these S levels.

However, where steels require an aim of 0.025 S, or more, practice refinements such as the method of Ca addition, proper Ca/Al balance, etc. provide proper sulfide shape control.

One of the important features of this invention is the ability to carry out the foregoing at a very low refining temperature; that is, with a low melting point slag, thereby achieving all the advantages which those skilled in the art will realize will flow therefrom, including short cycle times and minimal ladle (and furnace) refractory erosion. Specifically, it has been discovered that all of the foregoing advantages—sulfur removal to ELS grades, flake free steel, etc.—can be achieved at a process temperature of approximately 2,840° F. which, as those skilled in the art will appreciate, is contrary to conventional wisdom. Ordinarily, it is believed that high lime slags, whose fluidity must be controlled by high FeO contents (i.e.: up to 30% FeO) are required or else heavy amounts of florspar must be used. It has been found however that high FeO contents causes the melter to lose control of the alloys, and consequently high FeO content slags should be avoided. Florspar gives quite erratic results.

A practical, readily achievable process temperature of 2,840° has been established by reference to known slag system characteristics and the capabilities of the VAD system.

With the appropriate Ca/Al balance, the non-metallics formed will be low melting point types readily fluxed out of the steel. As those skilled in the art will appreciate, too much Ca or Al will result in solid type non-metallics which are readily entrapped.

The cycle time in the VAD system can be so regulated with experience that turnaround times of as little as 30 minutes can be achieved.

Four specific examples of steel heats processed according to the foregoing principles and procedure are set out in Table I.

TABLE I

CHEMISTRY ACHIEVED
HEATS 233500, 233504, 133936, 243530

| C | Mn | P | S | Si | Ni | Cr | Mo | V | Al | Ti | Ca |
|---|---|---|---|---|---|---|---|---|---|---|---|
| .34 | .59 | .008 | .001 | .25 | 2.21 | 1.09 | .50 | .12 | .000 | .0033 | 24 PPM |
| .33 | .59 | .008 | .002 | .25 | 2.12 | 1.00 | .51 | .11 | .002 | .0041 | 17 PPM |
| .34 | .64 | .009 | .004 | .17 | 2.21 | .94 | .49 | .12 | .001 | .0029 | 15 PPM |
| .35 | .59 | .008 | .001 | .19 | 2.22 | .98 | .50 | .11 | .002 | .0032 | 5 PPM |

Table II shows the elemental controls obtainable.

TABLE II

CHEMISTRY CONTROLS ATTAINABLE

| C | Mn | Si | Ni | Cr | Mo | V | Al | Ca |
|---|---|---|---|---|---|---|---|---|
| ±.01 | ±.03 | ±.03 | ±.05 | ±.08 | ±.01 | ±.01 | ±.005 | ±10 PPM |

Table III shows the relationship between hydrogen control and time in the VAD.

TABLE III $H_2$ CONTROL VS TOTAL TIME IN VAD

| Heat No | Before VAD | Teem | Total VAD Time |
|---|---|---|---|
| 233500 | 4.0 | 1.5 | 20 minutes |
| 233504 | 4.0 | 1.5 | 20 minutes |
| 133936 | 3.5 | 1.3 | 23 minutes |
| 243530 | 4.2 | 1.6 | 38 minutes |

The 38 minute VAD time heat required an additional 15 minutes of arcing in the VAD for temperature control after the Ca addition during which approximately two-thirds of the Ca was lost.

The sulfide shape control obtainable by use of this invention is illustrated in FIG. 1. This Figure shows, as the legend indicates, the final sulfide shapes for a resulfurized 0.031 S steel and an ELS steel which contains 0.001 S. As will be noted, the sulfide inclusions are round and globular in nature which, as those skilled in the art will readily appreciate, have minimum impact on transverse properties.

Reference is made, for comparison purposes, to a prior art steel illustrated in FIG. 2. From this steel it will be noted that sulfide stringers predominate, as compared to the light round globular oxides of FIG. 1. The long stringers indicate a lack of chemical deoxidation balance in this prior art steel. The chemical analysis and physical test results of the foreign steel was as follows:

TABLE IV

REFERENCE STEEL
CHEMICAL ANALYSIS-WEIGHT PERCENT

| C | Mn | P | S | Si | Ni | Cr | Mo | V | Al |
|---|---|---|---|---|---|---|---|---|---|
| .59 | .71 | .034 | .032 | .19 | 1.65 | 1.07 | .46 | .08 | .016 |

PHYSICAL TESTING RESULTS

| | |
|---|---|
| Tensile Strength | 202,500 PSI |
| Yield Strength | 186,000 PSI |
| Elongation | 10.0% |
| Reduction of Area | 32.5% |
| Charpy V-Notch | |
| at 200° F. | 13 Ft.-Lbs. |
| at 400° F. | 21 Ft.-Lbs. |

The mechanical properties, transverse, obtained in steels processed according to the principles of this invention are illustrated in Table V.

TABLE V

MECHANICAL PROPERTIES (TRANSVERSE)

| Heat | Tensile | Yield | Elong | R A | Charpy at −40° |
|---|---|---|---|---|---|
| 244,500 | 180,000 | 163,500 | 15.0 | 48.6 | 34.0 |
| 233,504 | 179,500 | 163,000 | 14.0 | 45.2 | 31.2 |
| 133,936 | 180,750 | 165,000 | 14.2 | 44.9 | 24.6 |
| 243,530 | 186,000 | 169,600 | 13.8 | 40.8 | 28.1 |
| 4-Heat Avg. | 181,500 | 165,000 | 14.2 | 44.5 | 30.0 |

From a study of the above figures, it will be noted that the U.S. Department of Defense requirements are easily met.

As a further check on the quality of steel produced, one of the example steels was evaluated to the AMS 2300 Spec (Electro Slag Remelt requirements) and to the AMS 230 Spec (Aircraft Quality requirements). The results are shown in Table VI.

TABLE IV

AMS 2300
ESR REQUIREMENT $\frac{\text{FREQUENCY}}{\text{SEVERITY}} = \frac{0.651}{1.397}$ MAX. SPECIFIED $\frac{.025}{.050}$

AMS 2301
AIRCRAFT QUALITY REQUIREMENT $\frac{\text{FREQUENCY}}{\text{SEVERITY}} = \frac{0}{0}$ Rating MAX. SPECIFIED $\frac{.067}{0.55}$ It should be noted that the AMS 2300 electro slag remelt results are colored by the mandated deoxidation practices dictated by the specifications for the heat. No aluminum was to be added (minus MAX. 0.010 allowed) and a Ca type addition after vacuum degassing was essential. As a result the low melting point non-metallics were not formed, resulting in very small Ca rich non-metallics.

Additional improvements in ratings will be possible with an all basic lined ladle. The ladle used in the exemplary heats was 50/75% alumina except for the basic slag line.

From the above it will be noted that the fluid, low melting point slag process described will yield the following results:

(a) exceptional hydrogen removal for all types of steels;

(b) excellent sulfur removal;

(c) exceptional deoxidation control to a point where only low melting point non-metallics are formed;

(d) excellent fluxing out of low melting point non-metallics;

(e) improved teeming practices in that the formation of teats is avoided; and (f) final quality approaching ESR melting.

With respect to hydrogen removal it should be noted that the usual standard for flake free, low alloy steel of 2.0 is not applicable to the ELS steels for which this invention is particularly well adapted. That is, with normal low alloy steels a hydrogen content of 2.0 is acceptable for the elimination of flaking. However, it has been found that very low sulfur steels are very susceptible to flaking, and the normal 2.0 max. hydrogen limit is not acceptable. From Table III it will be noted that average hydrogen levels of approximately 1.5 ppm are achieved, and, indeed, further work has disclosed that average hydrogen values of 1.1, including many heats of less than 1.0 ppm, can be achieved on a consistent basis. Accordingly, an added, and unexpected advantage of the disclosed process is that the flake free level for ELS steels can consistently be achieved.

With respect to the ability to flux out low melting point non-metallics and teeming difficulties encountered with prior processes, the following can be observed. In prior processes, the teeming stream on occasion would gradually decrease in diameter until, in some cases, teeming would terminate altogether. Analysis of the blockage formed in the teeming nozzle disclosed that solid non-metallics had been formed. As these non-metallics globurated the teeming stream was decreased and, of course, during the teeming process, such non-metallics would also drop off from moment to moment and fall into the ingot where they would be present in the final steel product. With the use of this invention the formation of such insoluble non-metallics is totally avoided, thus ensuring that teeming is carried out in a normal manner on a volume flow rate basis and undesirable non-metallics do not find their way into the final product.

The effectiveness of low melting point slags with their consequent excellent sulfur and hydrogen reduction is achieved through the unique combination of vacuum and violent agitation and, whenever necessary, the ability to simultaneously apply vacuum, agitation and the heat necessary to carry out the process at an acceptable temperature level. The use of vacuum, particularly, is important in that by causing droplets of molten metal to be thrown upwardly into the vacuum environment, due to the purging gas, with a consequent repassage of the droplets of metal through the fluid, low melting point slag, hydrogen is removed from droplets of molten steel above the body of the melt and while momentarily exposed to the vacuum environment, and sulfur removal occurs during the two passages of the droplets through the slag—once on the way up and again on the way down. It is obviously essential therefore that the slag remain very fluid; if a crust forms, which those skilled in the art often believed would happen at the low operating temperatures here disclosed, the process will become inoperative.

Of further significance is the fact that only low melting point non-metallics are formed when following the above-described procedures. As a result, the non-metallics which do form are easy fluxed out of the steel prior to teeming and the teeming operation proceeds smoothly, and no residual non-metallics find their way into the final steel product.

An aim treatment temperature of 2840° F. yields the best results. Although an exemplary description of the invention has been disclosed, it will at once be apparent to those skilled in the art that variations can be made on individual features of the invention. Accordingly it is intended that the scope of the disclosed invention be limited solely by the scope of the hereinafter appended claims, when interpreted in light of their relevant prior art, and not by the foregoing exemplary description.

We claim:

1. In a method of refining molten steel the steps of providing a layer of fluid slag having the capability of decreasing the sulfur content of the steel, subjecting the molten steel, including the slag, to a sub-atmospheric pressure sufficiently low to decrease the hydrogen content of the steel, agitating the molten steel simultaneously with subjection to the sub-atmospheric pressure, the degree of agitation being sufficiently violent to cause portions of molten steel to be projected from the surface region of the molten steel upwardly through the molten steel and fluid slag and into the vacuum environment there above prior to returning to the molten steel through the fluid slag, and adding heat to the molten steel at a time when the molten steel is simultaneously subjected to a vacuum and agitation, the slag layer being substantially entirely fluid during the time when portions of the molten steel pass upwardly there through and return, said slag layer being a low melting point slag during the period sulfur and hydrogen removal takes place.

2. The method of refining molten steel of claim 1 further characterized in that the heat is added to the molten steel by a multi-phase alternating current heating arc which is maintained directly between non-consumable electrodes and the molten steel.

3. The method of refining molten steel of claim 1 further characterized in that the agitation of the molten steel is derived from the upward passage of a purging agent therethrough.

4. The method of refining molten steel of claim 2 further characterized in that the purging agent is released into the steel at a location or locations sufficiently far beneath the surface of the molten steel to achieve temperature and chemical homogeniety in the molten steel in the available treatment time.

5. The method of refining steel of claims 1 or 2 further characterized in that the ratio of lime to silica in the slag is between from about 2:1 to about $2\frac{1}{2}$/2:1, and the FeO content of the steel shortly after refining commences is on the order of about 0.5% by weight.

6. The method of refining steel of claim 5 further characterized in that the slag does not contain fluidizing agents in an amount to significantly affect the refining activity of the slag or the alloy content of the molten steel at the operating temperatures.

7. The method of refining steel of claim 1 further characterized in that the process is continued for a period of time sufficient to yield flake free steel irrespective of the final sulfur content.

8. The method of refining steel of claim 1 further characterized in that the molten steel and slag is subjected to the simultaneous sub-atmospheric pressure and agitation prior to the addition of heat via the alternating current arcs.

9. In a method of making flake free, extra low sulfur steel on a commercial production scale, the steps of establishing a layer of low melting point fluid slag having a lime to silica or a lime to alumina ratio in the range of from about 2:1 to about $2\frac{1}{2}$/2:1 and a low FeO content on a heat of molten steel, the initial FeO content of the slag being no more than that quantity which will convert to a white, disintegrating slag of about 0.5% by weight of the slag layer shortly after exposure to post-melting treatment, subjecting the molten steel, including said slag, to a sub-atmospheric pressure sufficiently low, in conjunction with further process operations, to decrease the hydrogen content of the steel into the flake free range, simultaneously agitating the molten steel by the upward passage of a gaseous purging agent from a location remote from the surface in an amount, in conjunction with the sub-atomospheric pressure and other inherent mechanisms which occur naturally, to cause a violent agitation at the surface whereby portions of the molten steel are projected upwardly through the fluid slag and into the sub-atmospheric environment thereabove from whence said portions pass downwardly through the fluid slag and into the molten steel, and adding heat to the molten steel at a time when the molten steel is simultaneously subjected to vacuum and agitation, said heat being derived from a multi-phase alternating current heating arc maintained directly between, non-consumable electrodes and the molten steel.

10. The method of refining molten steel of claim 9 further characterized in that the arc heat is added at a vacuum which is above the glow range of the system.

11. The method of claims 9 or 10 further characterized in that the purging agent is selected from the group consisting essentially of the inert gasses and dry air.

12. Steel produced by the process of claim 1.

13. Steel produced by the process of claim 9.

* * * * *